US005944607A

United States Patent [19]

Crane

[11] Patent Number: 5,944,607

[45] Date of Patent: Aug. 31, 1999

[54] REMOTE CONTROL SYSTEM FOR OPERATING TOYS

[75] Inventor: John J. Crane, Ramona, Calif.

[73] Assignee: Rokenbok Toy Company, Cardiff, Calif.

[21] Appl. No.: 08/580,753

[22] Filed: Dec. 29, 1995

[51] Int. Cl.[6] ..... A63H 30/04

[52] U.S. Cl. ..... 463/39; 446/454; 446/456; 446/470

[58] Field of Search ..... 463/40, 62, 63, 463/39; 446/454, 456, 457, 470, 465, 431, 436, 441

[56] References Cited

U.S. PATENT DOCUMENTS

| | | | |
|---|---|---|---|
| 3,303,821 | 2/1967 | Harris | 446/456 |
| 3,400,488 | 9/1968 | Phillpott et al. | 446/456 |
| 3,482,046 | 12/1969 | Hughson et al. | 446/456 |
| 3,596,400 | 8/1971 | Cheng | 446/454 |
| 3,639,755 | 2/1972 | Wrege | 246/187 B |
| 3,705,387 | 12/1972 | Stern et al. | 446/454 |
| 3,722,135 | 3/1973 | Jacobson | 446/425 |
| 3,782,031 | 1/1974 | Byron | 446/292 |
| 3,926,434 | 12/1975 | Cannon, Jr. | 104/301 |
| 4,080,602 | 3/1978 | Hattori et al. | 446/454 |
| 4,087,799 | 5/1978 | Brouwer | 200/61.43 |
| 4,135,181 | 1/1979 | Bogacki et al. | 340/310.01 |
| 4,141,553 | 2/1979 | Beny et al. | 463/63 |
| 4,171,468 | 10/1979 | Reiner | 370/213 |
| 4,197,672 | 4/1980 | Mabuchi et al. | 446/456 |
| 4,213,270 | 7/1980 | Oda | 446/456 |
| 4,226,292 | 10/1980 | Monte et al. | 180/6.5 |
| 4,247,107 | 1/1981 | Smith, III et al. | 463/62 |
| 4,334,221 | 6/1982 | Rosenhagen et al. | 463/6 |
| 4,406,085 | 9/1983 | Rhodes | 446/456 |
| 4,563,626 | 1/1986 | Ohtake | 370/103 |
| 4,654,659 | 3/1987 | Kubo | 446/454 |
| 4,817,948 | 4/1989 | Simonelli | 463/6 |
| 4,938,483 | 7/1990 | Yavetz | 446/456 |
| 5,073,750 | 12/1991 | Coron | 318/587 |
| 5,098,110 | 3/1992 | Yang | 463/39 |
| 5,135,427 | 8/1992 | Suto et al. | 446/433 |
| 5,148,159 | 9/1992 | Clark et al. | 340/825.22 |
| 5,364,108 | 11/1994 | Esnouf | 463/9 |
| 5,429,543 | 7/1995 | Tilbor et al. | 446/456 |
| 5,435,553 | 7/1995 | Arima et al. | 463/6 |
| 5,435,768 | 7/1995 | Dunleavy | 446/427 |
| 5,452,901 | 9/1995 | Nakada et al. | 446/454 |
| 5,471,668 | 11/1995 | Soenen et al. | 455/352 |
| 5,474,486 | 12/1995 | Chilton et al. | 446/456 |

FOREIGN PATENT DOCUMENTS

| | | |
|---|---|---|
| 0227614 | 9/1985 | Germany . |
| 4219780 | 12/1993 | Germany . |
| 2285225 | 12/1993 | United Kingdom . |

*Primary Examiner*—Jessica J. Harrison
*Assistant Examiner*—James Schaaf
*Attorney, Agent, or Firm*—Ellsworth R. Roston; Fulwider Patton Lee & Utecht, LLP

[57] ABSTRACT

When manually closed, switches in pads select toy vehicles and the operation of motors for moving the vehicles in different directions and moving in different directions a receptacle for holding transportable elements (e.g. marbles). When interrogated by a central station, each pad sends through wires to the station signals indicating the switch closures in such pad. Such station produces first binary signals addressing the vehicle selected by such pad and second binary signals identifying the motor control operations in such vehicle. Thereafter the switches identifying in such pad the motor control operations in such selected vehicle can be closed without closing the switches identifying such vehicle. The first and second signals for each vehicle are transmitted by wireless to all of the vehicles at a common carrier frequency modulated by the first and second binary signals. The vehicle identified by the transmitted address demodulates the modulating signals and operates its motors in accordance with such demodulation. When the station fails to receive signals from a pad for a particular period of time, the vehicle previously selected by such pad can be selected by another pad and such pad can select that vehicle or another vehicle. A cable may couple two (2) central stations (one as a master and the other as a slave) to increase the number of pads controlling the vehicles. Stationary accessories (e.g. elevator) connected by wires to the central station become operative when selected by the pads.

118 Claims, 4 Drawing Sheets

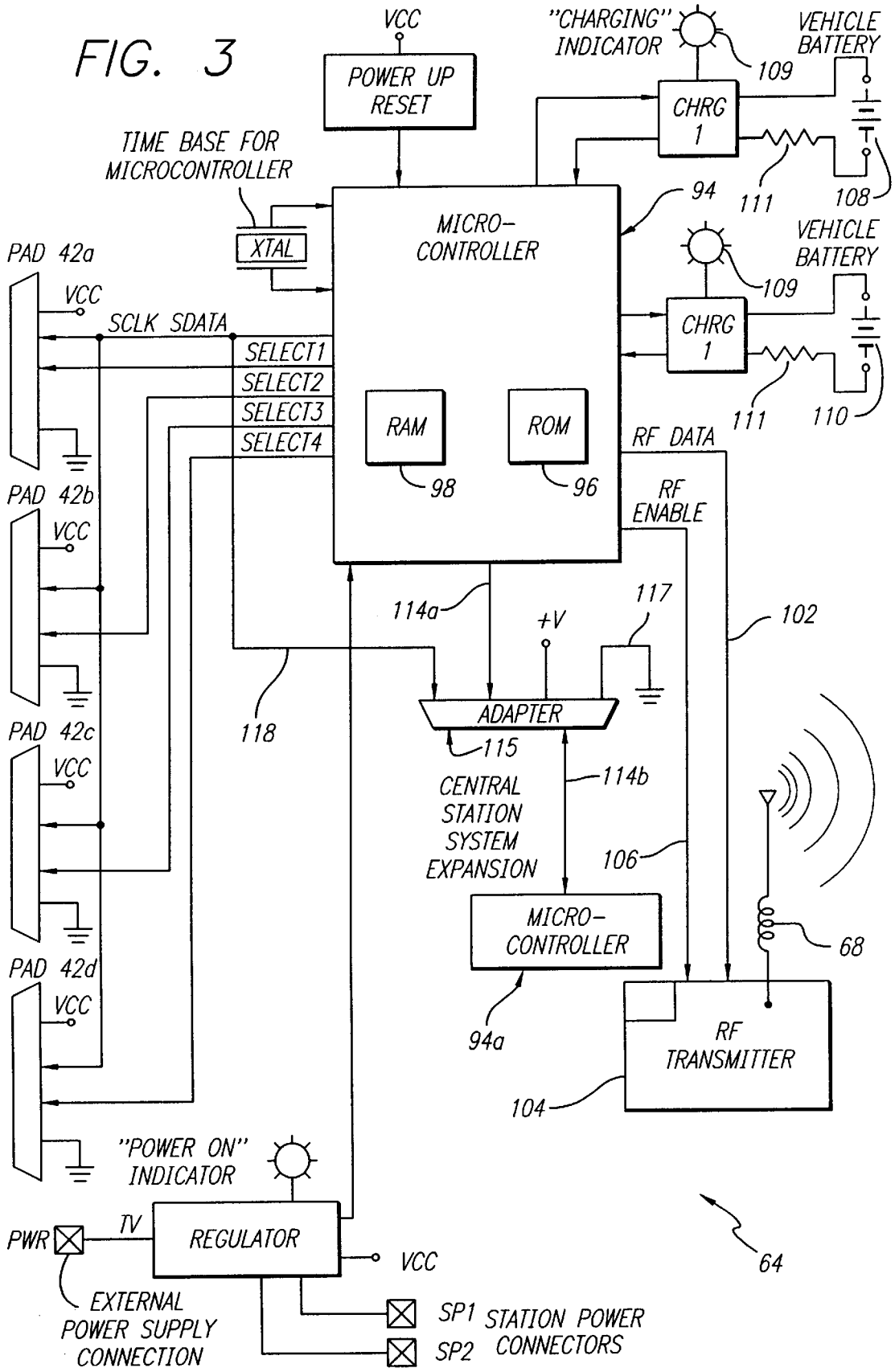
FIG. 3
VCC
POWER UP RESET
"CHARGING" INDICATOR
VEHICLE BATTERY
109
CHRG 1
TIME BASE FOR MICROCONTROLLER
XTAL
MICRO-CONTROLLER
94
111
108
VEHICLE BATTERY
109
CHRG 1
111
110
PAD 42a
VCC
SCLK SDATA
SELECT1
SELECT2
SELECT3
SELECT4
RAM
ROM
98
96
RF DATA
RF ENABLE
PAD 42b
VCC
114a
+V
117
102
118
ADAPTER
115
PAD 42c
VCC
CENTRAL STATION SYSTEM EXPANSION
114b
106
MICRO-CONTROLLER
68
PAD 42d
VCC
94a
RF TRANSMITTER
104
"POWER ON" INDICATOR
PWR
TV
REGULATOR
VCC
64
EXTERNAL POWER SUPPLY CONNECTION
SP1
SP2
STATION POWER CONNECTORS VCC
POWER UP RESET
VCC
122
12
134
TIME BASE FOR MICROCONTROLLER
XTAL
MICRO-CONTROLLER
RAM
ROM
126
124
VEHICLE ADDRESS SELECT
128
130
132
MOTOR 1
28
TRANSISTOR DRIVER
4
120
MOTOR 2
30
TRANSISTOR DRIVER
4
120
MOTOR 3
32
TRANSISTOR DRIVER
4
120
MOTOR 4
33
TRANSISTOR DRIVER
4
120
POWER ON
69
RF POWER MANAGEMENT
RF RECEIVER
121
BATTERY
VCC
4.5V
GND

REMOTE CONTROL SYSTEM FOR OPERATING TOYS

This invention relates to a system for and method of, operating remotely controlled vehicles simultaneously in a somewhat confined area to provide a pleasurable use by people of all ages with youthful minds. In the system of this invention, the vehicles can be remotely controlled to perform competitive or cooperative tasks. The system of this invention includes pads for operation by the users, vehicles remotely controlled in accordance with the operation of the pads and a central station for co-ordinating the operation of the pads and the vehicles. In addition to the inventive aspects of the system and method discussed above, each of the pads, the central station and the vehicles includes features of an inventive nature. The system of this invention also includes stationary plants (e.g. power plants and elevators) which are controlled by the operation of the pads. The invention additionally relates to methods including methods for controlling the operation of the vehicles on a remotely controlled basis.

BACKGROUND OF THE INVENTION

Various types of play systems exist, and have existed for some time, in which vehicles are moved on a remotely controlled basis. However, such systems generally provide one hand-held unit and one remotely controlled vehicle for operation by the hand-held unit. Examples of a vehicle in such a system are an automobile or an airplane. Furthermore, the functions of the remotely controlled unit, other than movement along a floor or along the ground or in the air, are quite limited.

Other types of play systems involve the use of blocks for building structures. These blocks often include components in the blocks for providing an interlocking relationship between abutting blocks. In this way, elaborate structures can be created by users with creative minds. However, such structures are generally built by hand.

Tests have indicated that there is a desirability, and even a need, for play systems in which vehicles are remotely operated to perform functions other than to move aimlessly along a floor or along the ground. For example, tests have indicated that there is a desirability, and even a need, for a play system in which the remotely controlled vehicles can transport and manipulate elements such as blocks to construct creative structures. There is also a desirability, and even a need for play systems in which a plurality of vehicles can be remotely controlled by elements such as switches in hand-held pads to compete against one another in performing a first task or to cooperate in performing a second task such as building a miniature community through the transport and manipulation of miniature blocks. Such a desirability, or even a need, has existed for a long period of time, probably decades, without a satisfactory resolution.

BRIEF DESCRIPTION OF THE INVENTION

This invention provides a play system for use by people of all ages with youthful minds. It provides for a simultaneous control by each player of an individual one of a plurality of remotely controlled vehicles. This control is provided by the operation by each such player of switches in a hand-held unit or pad to control the movement of an individual one of the remotely controlled vehicles and the performance of different functions (e.g. the movement of blocks or marbles) by such remotely controlled vehicles. Each of the remotely controlled vehicles in the system of this invention can be operated in a competitive or a cooperative relationship with others of the remotely controlled vehicles. The vehicles can be constructed to pick up and transport elements such as blocks or marbles and to deposit such elements at selectively displaced positions.

In one embodiment of the invention, switches in pads control when manually closed the selection of toy vehicles and the operation of motors for moving the vehicles forwardly, rearwardly to the left and to the right and moving upwardly and downwardly (and rightwardly and leftwardly) a receptacle for holding transportable elements (e.g. marbles or blocks).

When sequentially and cyclically interrogated by a central station, each pad sends through wires to the station signals indicating the switch closures in such pad. Such station produces first binary signals addressing the vehicle selected by such pad and second binary signals identifying the motor control operations in such vehicle. Thereafter the switches identifying in such pad the motor control operations in such selected vehicle can be closed without closing the switches identifying such vehicle.

The first and second signals for each vehicle are transmitted by wireless to all of the vehicles at a common carrier frequency modulated by the first and second binary signals. The vehicle identified by the transmitted address demodulates the modulating signals and operates its motors to move the vehicle in accordance with such demodulation. When the station fails to receive signals from a pad for a particular period of time, the vehicle selected by such pad becomes available for selection by such pad or by another pad furthermore, and such pad can select that vehicle or another vehicle.

A cable may couple two (2) central stations (one as a master and the other as a slave) to increase the number of pads controlling by the vehicles. Stationary accessories (e.g. an elevator) connected by wires to the central station become operative when selected by the pads.

BRIEF DESCRIPTION OF THE DRAWINGS

In the drawings:

FIG. 3 is a schematic diagram, primarily in block form, of the different features included in a central station included in the system shown in FIG. 1.

DETAILED DESCRIPTION OF THE INVENTION

Figure 1:
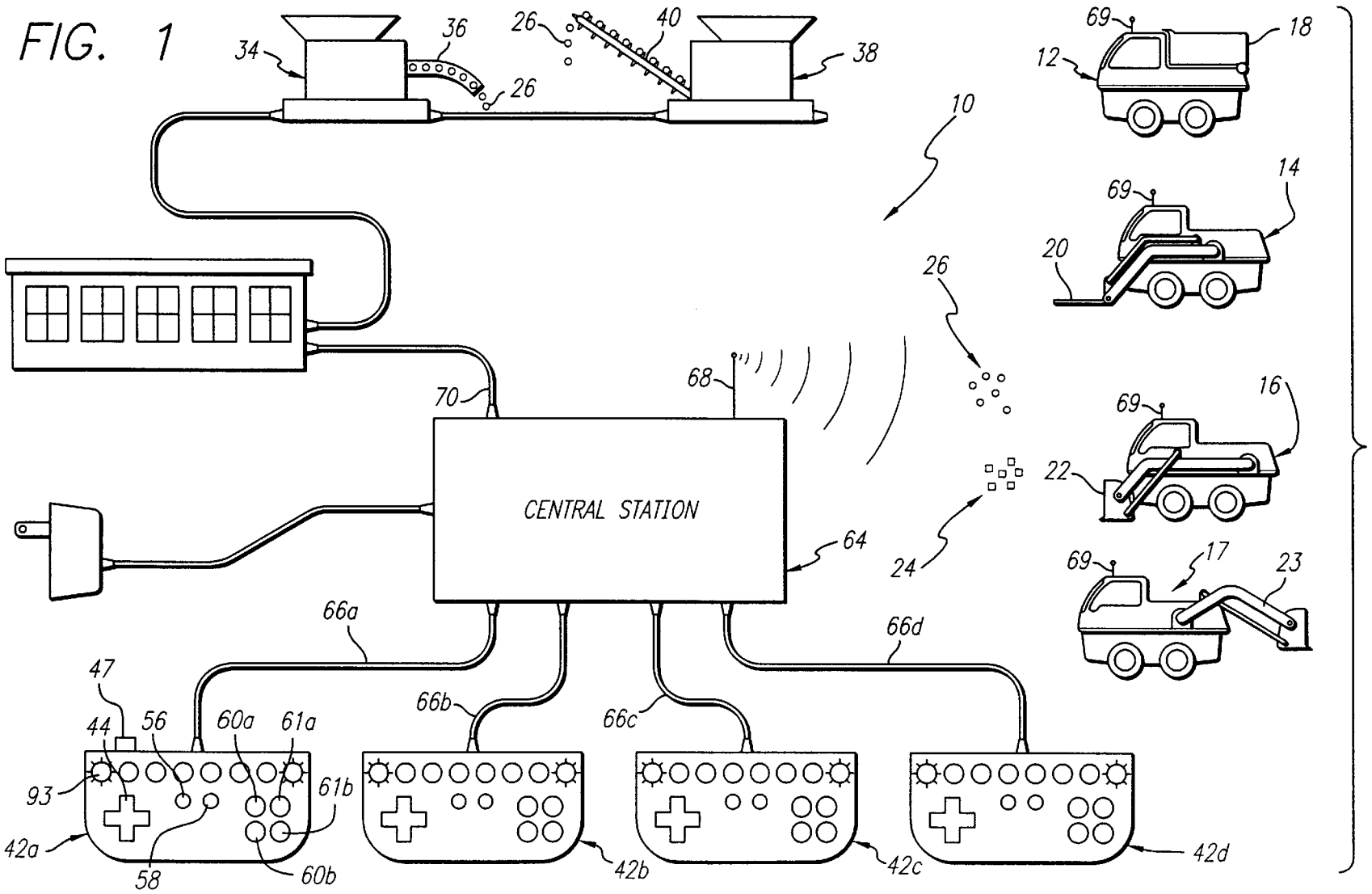
FIG. 1 is a schematic diagram, primarily in block form, of a system constituting one embodiment of the invention.

In one embodiment of the invention, a system generally indicated at 10 in FIG. 1 is provided for controlling the selection and operation of a plurality of toy vehicles. Illustrative examples of toy vehicles constitute a dump truck generally indicated at 12, a fork lift generally indicated at 14, a skip loader generally indicated at 16 and another form of skip loader generally indicated at 17. The toy vehicles such as the dump truck 12, the fork lift 14 and the skip loaders 16 and 17 are simplified versions of commercial units performing functions similar to those performed by the toy vehicles 12, 14, 16 and 17. For example, the dump truck 12 may include a working or transport member such as a pivotable bin or container 18; the fork lift 14 may include a working or transport member such as a pivotable platform 20; the skip loader 16 may include a working or transport member such as a pivotable bin or container 22 disposed at the front end of the skip loader; and the skip loader 17 may include a working or transport member such as a pivotable bin or container 23 disposed at the rear end of the skip loader. The working or transport members such as the pivotable bin or container 18, the pivotable platform 20 and the pivotable bins or containers 22 and 23 are constructed to carry storable and/or transportable elements such as blocks 24 or marbles 26 shown schematically in FIG. 1.

Each of the dump truck 12, the fork lift 14 and the skip loaders 16 and 17 may include a plurality of motors. For example, the dump truck 12 may include a pair of reversible motors 28 and 30 (FIG. 4) operable to move the dump truck forwardly, rearwardly, to the right and to the left. The motor 28 controls the movement of the front and rear left wheels and the motor 30 controls the movement of the front and rear right wheels. Similar motors may be provided for each of the fork lift 14 and the skip loaders 16 and 17.

When the motors 28 and 30 are simultaneously operated in one direction, the dump truck 12 moves forwardly. The vehicle 12 moves rearwardly when the motors 28 and 30 are operated in the opposite direction. The vehicle 12 turns toward the right when the motor 30 is operated without a simultaneous operation of the motor 28. The vehicle 12 turns toward the left when the motor 28 is operated without a simultaneous operation of the motor 30.

The vehicle 12 spins to the left when the motor 30 operates to move the vehicle forwardly at the same time that the motor 28 operates to move the vehicle rearwardly. The vehicle 12 spins to the right when the motors 28 and 30 are operated in directions opposite to the operations of the motors in spinning the vehicle to the left.

Another reversible motor 32 in the dump truck 12 operates in one direction to pivot the bin 18 upwardly and in the other direction to pivot the bin downwardly. An additional motor 33 may operate in one direction to turn the bin 18 to the left and in the other direction to turn the bin to the right.

The construction of the motors 28, 30, 32 and 33 and the disposition of the motors in the dump truck 12 to operate the dump truck are considered to be well known in the art. The fork lift 14 and the skip loaders 16 and 17 may include motors corresponding to those described above for the dump truck 12.

The system 10 may also include stationary plants or accessories. For example, the system 10 may include a pumping station generally indicated at 34 (FIG. 1) for pumping elements such as the marbles 26 through a conduit 36. The system may also include a conveyor generally indicated at 38 for moving the elements such as the marbles 26 upwardly on a ramp 40. When the marbles reach the top of the ramp 40, the elements such as the marbles 26 may fall into the bin 18 in the dump truck 12 or into the bin 22 in the skip loader 16. For the purposes of this application, the construction of the pumping station 34 and the conveyor 38 may be considered to be within the purview of a person of ordinary skill in the art.

The system 10 may also include a plurality of hand-held pads generally indicated at 42*a*, 42*b*, 42*c* and 42*d* (FIG. 1). Each of the pads 42*a*, 42*b*, 42*c* and 42*d* may have a substantially identical construction. Each of the pads may include a plurality of actuatable buttons. For example, each of the pads may include a 4-way button 44 in the shape of a cross. Each of the different segments in the button 44 is connected to an individual one of a plurality of switches 46, 48, 50 and 52 in FIG. 2.

When the button 44 is depressed at the segment at the top of the button, the switch 46 is closed to obtain the operation of the motors 28 and 30 (FIG. 4) in moving the vehicle 12 forwardly. Similarly, when the segment at the bottom of the button 44 is depressed, the switch 48 is closed to obtain the operation of the motors 28 and 30 (FIG. 4) in moving the vehicle 12 rearwardly. The selective depression of the right and left segments of the button 44 cause the motors 28 and 30 to operate in and the left.

It will be appreciated that pairs of segments of the button 44 may be simultaneously depressed. For example, the top and left portions of the button 44 may be simultaneously depressed to obtain a simultaneous movement of the vehicle 12 forwardly and to the left. However, a simultaneous actuation of the top and bottom segments of the button 44 will not have any effect since they represent contradictory commands. This is also true of a simultaneous depression of the left and right segments of the button 44.

Figure 2:
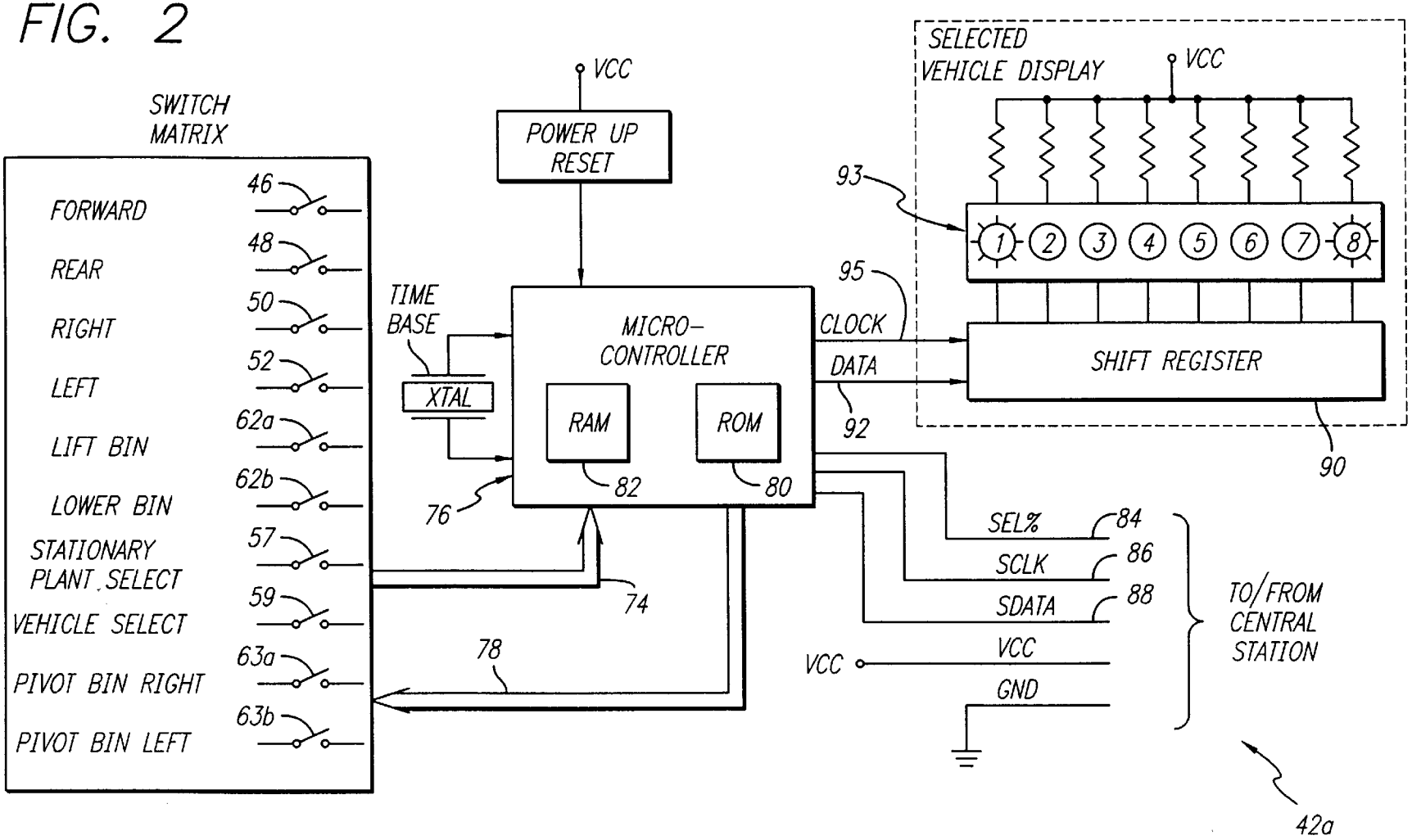
FIG. 2 is a schematic diagram, primarily in block form, of the different features in a pad included in the system shown in FIG. 1.

Each of the pads 42*a*, 44*b*, 42*c* and 42*d* may include a button 56 (FIG. 1) which is connected to a switch 57 (FIG. 2). Successive depressions of the button 56 on one of the pads within a particular period of time cause different ones of the stationary accessories or plants such as the pumping station 34 and the conveyor 38 to be energized. For example, a first depression of the button 56 in one of the pads 42*a*, 42*b*, 42*c* and 42*d* may cause the pumping station 34 to be energized and a second depression of the button 56 in such pad within the particular period of time may cause the conveyor 38 to be energized instead of the pumping station. When other stationary accessories are included in the system 10, each may be individually energized by depressing the button 56 a selective number of times within the particular period of time. This energizing of a selective one of the stationary accessories occurs at the end of the particular period of time. An adder is included in the pad 12 to count the number of depressions of the button 56 within the particular period of time.

A button 58 is provided in each of the pads 42*a*, 42*b*, 42*c* and 42*d* to select one of the vehicles 12, 14, 16 and 17. The individual one of the vehicles 12, 14, 16 and 17 selected at any instant by each of the pads 42*a*, 42*b*, 42*c* and 42*d* is dependent upon the number of times that the button is depressed in that pad within a particular period of time. For example, one (1) depression of the button 58 may cause the dump truck 12 to be selected and two (2) sequential selections of the button 58 within the particular period of time may cause the fork lift 14 to be selected.

Every time that the button 58 is actuated or depressed within the particular period of time, a switch 59 (in FIG. 2) is closed. The particular period of time for depressing the button 58 may be the same as, or different from, the particular period of time for depressing the button 56. An adder is included in the pad 12 to count the number of depressions of the button 58 within the particular period of time. This count is converted into a plurality of binary signals indicating the count. The count is provided at the end of the particular period of time.

Buttons 60*a* and 60*b* are also included on each of the pads 42*a*, 42*b*, 42*c* and 42*d*. When depressed, the buttons 60*a* and 60*b* respectively close switches 62*a* and 62*b* in FIG. 2. The closure of the switch 62*a* is instrumental in producing an operation of the motor 32 in a direction to lift the bin 18 in the dump truck 12 when the dump truck has been selected by the proper number of depressions of the button 58. In like manner, when the dump truck 12 has been selected by the proper number of depressions of the switch 58, the closure of the switch 62*b* causes the selective one of the bin 18 in the dump truck 12 to move downwardly as a result of the operation of the motor 32 in the reverse direction.

It will be appreciated that other controls may be included in each of the pads 42*a*, 42*b*, 42*c* and 42*d*. For example, buttons 61*a* and 61*b* may be included in each of the pads 42*a*, 42*b*, 42*c* and 42*d* to pivot the bin 18 to the right or left when the vehicle 12 has been selected. Such movements facilitate the ability of the bin 18 to scoop elements such as the blocks 24 and the marbles 26 upwardly from the floor or ground or from any other position and to subsequently deposit such elements on the floor or ground or any other position.

Switches 63*a* and 63*b* (FIG. 2) are respectively provided in the pad 42*a* in association with the buttons 61*a* and 61*b* and are closed by the respective actuation of the buttons 61*a* and 61*b* to move the bin or the platform in the vehicle 12 to the left or right when the vehicle has been selected. It will be appreciated that different combinations of buttons may be actuated simultaneously to produce different combinations of motions. For example, a bin in a selected one of the vehicles may be moved at the same time that the selected one of the vehicles is moved.

A central station generally indicated at 64 in FIG. 1 processes the signals from the individual ones of the pads 42*a*, 42*b*, 42*c* and 42*d* and sends the processed signals to the vehicles 12, 14, 16 and 17 when the button 58 on an individual one of the pads has been depressed to indicate that the information from the individual ones of the pads is to be sent to the vehicles. The transmission may be on a wireless basis from an antenna 68 (FIG. 1) in the central station to antennas 69 on the vehicles.

The transmission may be in packets of signals. This transmission causes the selected ones of the vehicles 12, 14, 16 and 17 to perform individual ones of the functions directed by the depression of the different buttons on the individual ones of the pads. When the commands from the individual ones of the pads 42*a*, 42*b*, 42*c* and 42*d* are to pass to the stationary accessories 34 and 38 as a result of the depression of the buttons 56 on the individual ones of the pads, the central station processes the commands and sends signals through cables 70 to the selected ones of the stationary accessories.

FIG. 2 shows the construction of the pad 42*a* in additional detail. It will be appreciated that each of the pads 42*b*, 42*c* and 42*d* may be constructed in a substantially identical manner to that shown in FIG. 2. As shown in FIG. 2, the pad 42*a* includes the switches 46, 48, 50 and 52 and the switches 57, 59, 62*a*, 62*b*, 63*a* and 63*b*. Buses 74 are shown as directing indications from the switches 46, 48, 50, 52, 57, 59, 62*a*, 62*b*, 63*a* and 63*b* to a microcontroller generally indicated at 76 in FIG. 2. Buses 78 are shown for directing signals from the microcontroller 76 to the switches in the pad 42A.

The microcontroller 76 is shown as including a read only memory (ROM) 80 and a random access memory (RAM) 82. Such a microcontroller may be considered to be standard in the computing industry. However, the programming in the microcontroller and the information stored in the read only memory 80 and the random access memory 82 are individual to this invention.

The read only memory 80 stores permanent information and the random access memory stores volatile (or impermanent) information. For example, the read only memory 80 may store the sequence in which the different switches in the pad 42*a* provide indications of whether or not they have been closed. The random access memory 82 may receive this sequence from the read only memory 80 and may store indications of whether or not the switches in the particular sequence have been closed for each individual one of the pads 42*a*, 42*b*, 42*c* and 42*d*.

The pad 42*a* in FIG. 2 receives the interrogating signals from the central station 64 through a line 84. These interrogating signals are not synchronized by clock signals on a line 86. Each of the interrogating signals intended for the pad 42*a* may be identified by an address individual to such pad. When the pad 42*a* receives such interrogating signals, it sends to the central station 64 through lines 88 a sequence of signals indicating the status of the successive ones of the switches 46, 48, 50 and 52 and the switches 57, 59, 62*a*, 62*b*, 63*a* and 63*b*. These signals are synchronized by the clock signals on the line 86. It will be appreciated that the status of each of the switches 57 and 59 probably is the first to be provided in the sequence since these signals indicate the selection of the stationary accessories 34 and 38 and the selection of the vehicles 12, 14, 16 and 17.

As previously indicated, the pad 42*a* selects one of the vehicles 12, 14, 16 and 17 in accordance with the number of closings of the switch 59. As the user of the pad 42*a* provides successive actuations or depressions of the button 58, signals are introduced to a shift register 90 through a line 92 to indicate which one of the vehicles 12, 14, 16 and 17 would be selected if there were no further depressions of the button. Each one of the depressions of the button 58 causes the indication to be shifted to the right in the shift register 90. Such an indication is provided on an individual one of a plurality of light emitting diodes (LED) generally indicated at 93. The shifting of the indication in the shift register 90 may be synchronized with a clock signal on a line 95. Thus, the illuminated one of the light emitting diodes 93 at each instant indicates at that instant the individual one of the vehicles 12, 14, 16 and 17 that the pad 42*a* has selected at such instant.

The central station 64 is shown in additional detail in FIG. 3. It includes a microcontroller generally indicated at 94 having a read only memory (ROM) 96 and a random access memory (RAM) 98. As with the memories in the microcontroller 76 in the pad 42*a*, the read only memory 96 stores permanent information and the random access memory 98 stores volatile (or impermanent) information. For example, the read only memory 96 sequentially selects successive ones of the pads 42*a*, 42*b*, 42*c* and 42*d* to be interrogated on a cyclic basis. The read only memory 96 also stores a plurality of addresses each individual to a different one of the vehicles 12, 14, 16 and 17.

Since the read only memory 96 knows which one of the pads 42*a*, 42*b*, 42*c* and 42*d* is being interrogated at each instant, it knows the individual one of the pads responding at that instant to such interrogation. The read only memory 96 can provide this information to the microcontroller 94 when the microcontroller provides for the transmittal of information to the vehicles 12, 14, 16 and 17. Alternatively, the microcontroller 76 in the pad 42*a* can provide an address indicating the pad 42*a* when the microcontroller sends the binary signals relating to the status of the switches 46, 48, 50 and 52 and the switches 57, 59, 62*a*, 62*b*, 63*a* and 63*b* to the central station 64.

As an example of the information stored in the random access memory 98 in FIG. 3, the memory stores information relating to each pairing between an individual one of the pads 42*a*, 42*b*, 42*c* and 42*d* and a selective one of the vehicles 12, 14, 16 and 17 in FIG. 1 and between each individual one of such pads and a selective one of the stationary accessories 34 and 38. The random access memory 98 also stores the status of the operation of the switches 46, 48, 50 and 52 for each pad and the operation of the switches 57, 59, 62*a*, 62*b*, 63*a* and 63*b* for each pad.

When the central station 64 receives from the pad 42*a* the signals indicating the closure (or the lack of closure) of the switches 46, 48, 50 and 52 and the switches 57, 59, 62*a*, 62*b*, 63*a* and 63*b*, the central station retrieves from the read only memory 96 the address of the individual one of the vehicles indicated by the closures of the switch 59 in the pad. The central station may also retrieve the address of the pad 42*a* from the read only memory 96.

The central station 64 then formulates in binary form a composite address identifying the pad 42*a* and the selected one of the vehicles 12, 14, 16 and 17 and stores this composite address in the random access memory 98. The central station 64 then provides a packet or sequence of signals in binary form including the composite address and including the status of the opening and closing of each of the switches in the pad 42*a*. This packet or sequence indicates in binary form the status of the closure each of the switches 46, 48, 50 and 52 and the switches 57, 59, 62*a*, 62*b*, 63*a* and 63*b*.

Each packet of information including the composite addresses and the switch closure information for the pad 42*a* is introduced through a line 102 in FIG. 3 to a radio frequency transmitter 104 in the central station 64. The radio frequency transmitter 104 is enabled by a signal passing through a line 106 from the microcontroller 94. This enabling signal is produced by the microcontroller 94 when the microcontroller confirms that it has received signals from the pad 42*a* as a result of the interrogating signals from the central station 64.

When the radio frequency transmitter 104 receives the enabling signal on the line 106 and the address and data signals on the line 102, the antenna 68 (also shown in FIG. 1) transmits signals to all of the vehicles 12, 14, 16 and 17. However, only the individual one of the vehicles 12, 14, 16 and 17 with the address indicated in the packet of signals from the central station 64 will respond to such packet of signals.

The microcontroller 94 stores in the random access memory 98 the individual ones of the vehicles such as the vehicles 12, 14, 16 and 17 being energized at each instant by the individual ones of the pads 42*a*, 42*b*, 42*c* and 42*d*. Because of this, the central station 64 is able to prevent the interrogated one of the pads 42*a*, 42*b*, 42*c* and 42*d* from selecting one of the energized vehicles. Thus, for example, if the vehicle 14 is being energized by one of the pads 42*a*, 42*b*, 42*c* and 42*d* at a particular instant, a first depression of the button 58 in the pad being interrogated at that instant will cause the vehicle 12 to be initially selected and a second depression of the button by such pad will cause the vehicle 14 to be skipped and the vehicle 16 to be selected.

Furthermore, in the example above where the pad 42*a* has previously selected the vehicle 14, the microcomputer 94 in the central station 64 will cause the vehicle 14 to be released when the pad 42*a* thereafter selects any of the vehicles 12, 16 and 17. When the vehicle 14 becomes released, it becomes available immediately thereafter to be selected by any one of the pads 42*a*, 42*b*, 42*c* and 42*d*. The release of the vehicle 14 by the pad 42*a* and the coupling between the pad 42*a* and a selected one of the vehicles 12, 14, 16 and 17 are recorded in the random access memory 98 in the microcontroller 94.

The vehicles 12, 14, 16 and 17 are battery powered. As a result, the energy in the batteries in the vehicles 12, 14, 16 and 17 tends to become depleted as the batteries provide the energy for operating the vehicles. The batteries in the vehicles 12 and 14 are respectively indicated at 108 and 110 in FIG. 3. The batteries 108 and 110 are chargeable by the central station 64 because the central station may receive AC power from a wall socket. The batteries are charged only for a particular period of time. This particular period of time is preset in the read only memory 96. When each battery is being charged for the particular period of time, a light 109 in a circuit with the battery becomes illuminated. The charging current to each of the batteries 108 and 110 may be limited by a resistor 111. The light 109 becomes extinguished when the battery has been charged.

Each central station 64 may have the capabilities of servicing only a limited number of pads. For example, each central station 64 may have the capabilities of servicing only the four (4) pads 42*a*, 42*b*, 42*c* and 42*d*. It may sometimes happen that the users of the system may wish to be able to service more than four (4) pads. Under such circumstances, the microcontroller 94 in the central station 64 and a microcontroller, generally indicated at 94*a*, in a second central station corresponding to the central station 64 may be connected by cables 114*a* and 114*b* to an adaptor generally indicated at 115.

One end of the cable 114*b* is constructed so as to be connected to a ground 117 in the adaptor 115. This ground operates upon the central station to which it is connected so that such central station is a slave to, or subservient to, the other central station. For example, the ground 117 in the adaptor 115 may be connected to the microcomputer 94*a* so that the central station including the microcomputer 94*a* is a slave to the central station 64. When this occurs, the microcontroller 94 in the central station 64 serves as the master for processing the information relating to the four (4) pads and the four (4) vehicles in its system and the four (4) pads and the four (4) vehicles in the other system.

The expanded system including the microcomputers 94 and 94*a* may be adapted so that the address and data signals generated in the microcomputer 94*a* may be transmitted by the antenna 68 in the central station 64 when the central station 64 serves as the master station. The operation of the central station 64*a* may be clocked by the signals extending through a line 118 from the central station 64 to the adaptor 115 and through a corresponding line from the other central station to the adaptor.

Figure 4:
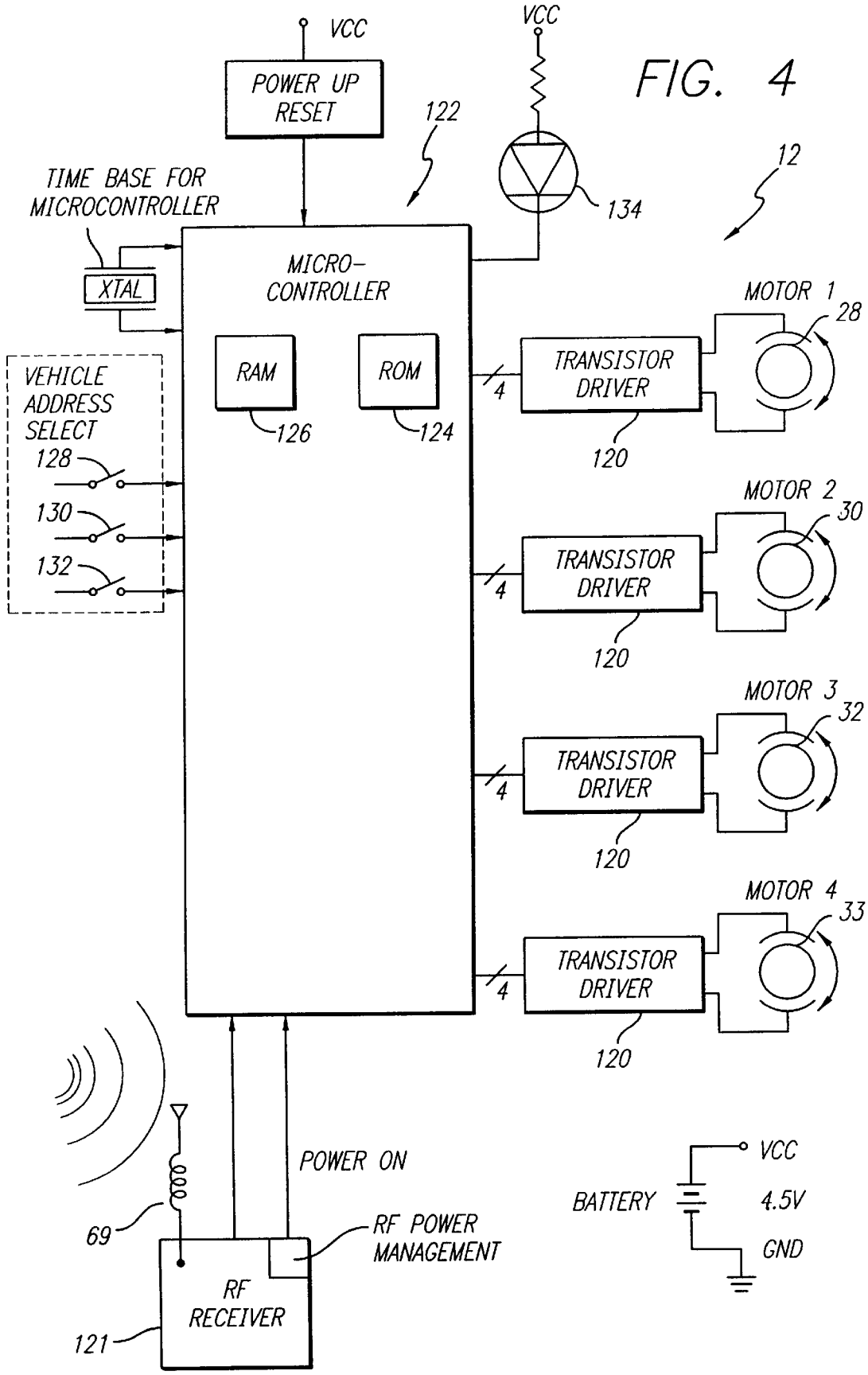
FIG. 4 is a schematic diagram, primarily in block form, of the different features in a vehicle included in the system shown in FIG. 1.

The vehicle 12 is shown in additional detail in FIG. 4. Substantially identical arrangements may be provided for the vehicles 14, 16 and 17. The vehicle 12 includes the antenna 69 for receiving from the central station 64 signals with the address of the vehicle and also includes a receiver 121 for processing the received signals. The vehicle 12 also includes the motors 28, 30, 32 and 33. Each of the motors 28, 30, 32 and 33 receives signals from an individual one of transistor drivers 120 connected to a microcontroller generally indicated at 122.

The microcontroller 122 includes a read only memory (ROM) 124 and a random access memory (RAM) 126. As with the memories in the pad 42*a* and the central station 64, the read only memory 124 may store permanent information and the random access memory 126 may store volatile (or impermanent) information. For example, the read only memory 124 may store information indicating the sequence of the successive bits of information in each packet for controlling the operation of the motors 28, 30, 32 and 33 in the vehicle 12. The random access memory 126 stores information indicating whether there is a binary 1 or a binary 0 at each successive bit in the packet.

The vehicle 12 includes a plurality of switches 128, 130 and 132. These switches are generally pre-set at the factory to indicate a particular Arabian number such as the number "5". However, the number can be modified by the user to indicate a different number if two central stations are connected together as discussed above and if both stations have vehicles identified by the numeral "5". The number can be modified by the user by changing the pattern of closure of the switches 128, 130 and 132. The pattern of closure of the switches 128, 130 and 132 controls the selection of an individual one of the vehicles such as the vehicles 12, 14, 16 and 17.

The pattern of closure of the switches 128, 130 and 132 in one of the vehicles can be changed when there is only a single central station. For example, the pattern of closure of the switches 128, 130 and 132 can be changed when there is only a single central station with a vehicle identified by the numeral "5" and when another user brings to the central station, from such other user's system, another vehicle identified by the numeral "5".

The vehicle 12 also includes a light such as a light emitting diode 130. This diode is illuminated when the vehicle 12 is selected by one of the pads 42*a*, 42*b*, 42*c* and 42*d*. In this way, the other users can see that the vehicle 12 has been selected by one of the pads 42*a*, 42*b*, 42*c* and 42*d* in case one of the users (other than the one who selected the vehicle 12) wishes to select such vehicle. It will be appreciated that each of the vehicles 12, 14, 16 and 17 may be generally different from the others so each vehicle may be able to perform functions different from the other vehicles. This is another way for each user to identify the individual one of the vehicles that the user has selected.

As previously indicated, the user of one of the pads such as the pad 42*a* selects the vehicle 12 by successively depressing the button 58 a particular number of times within a particular time period. This causes the central station 64 to produce an address identifying the vehicle 12. When this occurs, the central station 64 stores information in its random access memory 98 that the pad 42*a* has selected the vehicle 12. Because of this, the user of the pad 42*a* does not thereafter have to depress the button 58 during the time that the pad 42*a* is directing commands through the station 64 to the vehicle 12. As long as the buttons on the pad 42*a* are thereafter depressed within a particular period of time to command the vehicle 12 to perform individual functions, the microprocessor 94 in the central station 64 will direct the address of the vehicle to be retrieved from the read only memory 96 and to be included in the packet of the signals transmitted by the central station to the vehicle 12.

The read only memory 96 in the microprocessor 94 at the central station 64 stores information indicating a particular period of time in which the vehicle 12 has to be addressed by the pad 42*a* in order for the selective coupling between the pad and the vehicle to be maintained. The random access memory 98 in the microcontroller 94 stores the period of time from the last time that the pad 42*a* has issued a command through the central station 64 to the vehicle 12. When the period of time in the random access memory 98 equals the period of time in the read only memory 96, the microcontroller 94 will no longer direct commands from the pad 42*a* to the vehicle 12 unless the user of the pad 42*a* again depresses the button 58 the correct number of times within the particular period of time to select the vehicle 12.

The vehicle 12 also stores in the read only memory 124 indications of the particular period of time in which the vehicle 12 has to be addressed by the pad 42*a* in order for the selective coupling between the vehicle and the pad to be maintained. This period of time is the same as the period of time specified in the previous paragraph. The random access memory 126 in the microcontroller 122 stores the period of time from the last time that the pad 42*a* has issued a command to the vehicle 12.

As previously indicated, the button 58 in the pad 42*a* does not have to be actuated or depressed to issue the command after the pad 42*a* has initially issued the command by the appropriate number of depressions of the button. When the period of time stored in the random access memory 126 of the microcomputer 122 in the vehicle equals the period of time in the read only memory 124, the microcontroller 122 issues a command to extinguish the light emitting diode 130. This indicates to the different users of the system, including the user previously controlling the operation of the vehicle 121 that the vehicle is available to be selected by one of the users including the user previously directing the operation of the vehicle.

When one of the vehicles such as the vehicle 12 is being moved in the forward direction, the random access memory 126 records the period of time during which such forward movement of the vehicle 12 is continuously occurring. This period of time is continuously compared in the microcontroller 122 with a fixed period of time recorded in the read only memory 124. When the period of time recorded in the random access memory 126 becomes equal to the fixed period of time recorded in the read only memory 124, the microcontroller 122 provides a signal for increasing the speed of the movement of the vehicle 12 in the forward direction. Similar arrangements are provided for each of the vehicles 14, 16 and 17. This increased speed may illustratively be twice that of the original speed.

The system and method described above have certain important advantages. They provide for the operation of a plurality of vehicles by a plurality of users, either on a competitive or a co-operative basis. Furthermore, the vehicles can be operated on a flexible basis in that a vehicle can be initially selected for operation by one user and can then be selected for operation by another user after the one user has failed to operate the vehicle for a particular period of time. The vehicles being operated at each instant are also visible by the illumination of the lights 130 on the vehicle. The apparatus and method of this invention are also advantageous in that the vehicles are operated by the central station 64 on a wireless basis without any physical or cable connection between the central station and the vehicles.

Furthermore, the central station 64 is able to communicate with the vehicles in the plurality through a single carrier frequency. The system and method of this invention are also advantageous in that the vehicles can selectively perform a number of different functions including movements forwardly and rearwardly and to the left and the right and including movements of a container or bin or platform on the vehicle upwardly and downwardly or to the left or the right. Different movements can also be provided simultaneously on a co-ordinated basis.

There are also other significant advantages in the system and method of this invention. Two or more systems can be combined to increase the number of pads 142 controlling the operation of the vehicles 12, 14 16 and 17. In effect, this increases the number of users capable of operating the system. This combination of systems can be provided so that one of the systems is a master and the other is a slave. This prevents any confusion from occurring in the operation of the system. The system is also able to recharge the batteries in the vehicles so that use of the vehicles can be resumed after the batteries have been charged.

The system and method of this invention are also advantageous in the provision of the pads and the provision of the button and switches in the pads. As will be appreciated, the pads are able to select vehicles and/or stationary accessories through the operation of a minimal number of buttons and to provide for the operation of a considerable number of different functions in the vehicles with a minimal number of buttons. In co-operation with the central station, the pads are able to communicate the selection of vehicles to the central station without indicating to the station, other than on a time shared basis, the identities of the vehicles being selected. After selecting a vehicle, each pad does not thereafter have to indicate the identity of the vehicle as long as the pad operates the vehicle through the central station within a particular period of time from the last operation of the vehicle by the pad through the central station. Under such circumstances, it is sufficient for the pad to identify its own address to the selected vehicle within the particular period of time in order to continue to operate the selected vehicle.

Although this invention has been disclosed and illustrated with reference to particular embodiments, the principles involved are susceptible for use in numerous other embodiments which will be apparent to persons of ordinary skill in the art. The invention is, therefore, to be limited only as indicated by the scope of the appended claims.

I claim:

1. In combination, a plurality of vehicles each having first controls to provide a movement of the vehicle in different directions in accordance with the operation of the first controls and each having at least one member operable to perform functions and each having second controls to obtain the performance of the functions by the operable member, a plurality of pads each having a plurality of switches controlling the addressing of a one of the vehicles and controlling the movement of the addressed vehicle in the different directions and controlling the operation of the operable member in the addressed vehicle in performing the functions, and first means responsive sequentially to the operations of the switches in the pads in the plurality for addressing any ones of the vehicles, depending upon the switch operations in the pads, not addressed by any of the other pads and for providing for movements of the addressed vehicles and for the operations of the operable member in the addressed vehicles.

2. In a combination as recited in claim 1, second means responsive in each of the pads to the operation of the switches in the pad for transmitting to the first means signals indicating the operation of the switches in the pad, and third means included in the first means and responsive to the signals from the second means in the pads for sequentially addressing any ones of the vehicles, dependent upon the operation of the switches in the pads, not addressed by any of the other pads and for producing signals providing for the movements of the addressed vehicles and for the operation of the operable member in the addressed vehicles.

3. In a combination as recited in claim 2, the first means being operative to produce carrier signals at a common carrier frequency and to modulate the carrier signals in accordance with the operation of the switches in the pads and to transmit the carrier signals to all of the vehicles in the plurality, and fourth means disposed at the addressed vehicles for demodulating the modulated carrier signals representative of the vehicles to address the vehicles and to produce the movements of the addressed vehicles and to produce the operations of the operable member in the addressed vehicles, the first means being connected to the pads to provide power to the pads and to communicate with the pads.

4. In a combination as set forth in claim 2, means in each pad for providing a visual indication in the pad of any one of the vehicles being addressed by the operation of the switches in the pad.

5. In a combination as set forth in claim 1, means in each of the vehicles for providing an illumination identifying the vehicle during the time that the vehicle is being addressed by one of the pads.

6. In combination, a plurality of vehicles each movable forwardly and rearwardly and each turnable in first and second opposite directions and each having an operable member, each of the vehicles having drive members providing for the movement of the vehicle forwardly and rearwardly and for the turning of the vehicle in the opposite directions and for the operation of the operable member, a central station for sending signals to the vehicles to provide movements of the vehicles forwardly and rearwardly and turning movements of the vehicles in the first and second opposite directions and operations of the operable members in the vehicles, the central station providing signals with addresses individual to each of the vehicles, and a plurality of pads each constructed to address any one of the vehicles and each having a plurality of controls operable to introduce to the central station signals providing for the addressing of any one of the vehicles by the central station and signals indicating to the addressed vehicle the drive members to be actuated in the addressed vehicle and the type of actuation to be provided to such drive members in the addressed vehicle and signals indicating the operation of the operable member in the addressed vehicle, each of the pads being constructed to receive from the central station power to operate the pad and to communicate with the pad, the central station being constructed to transmit sequentially to all of the vehicles signals representative of the controls operated in the different pads.

7. In a combination as set forth in claim 6, the central station including means for providing a signal having a common carrier frequency for all of the vehicles and for modulating the common carrier frequency signal with signals addressing Man (each) of the vehicles in the plurality and identifying the drive members to be operated in the addressed vehicle and the operation of the operable members in the addressed vehicle, the central station being connected to the pads to provide power to the pads and to communicate with the pads.

8. In a combination as set forth in claim 7, each of the vehicles including means for receiving the modulated signals addressed from the central station to the vehicle at the common carrier frequency and for demodulating the modulations in the signals addressed to the vehicle and for operating the drive members and the operable member in the addressed vehicle in accordance with such demodulations.

9. In a combination as set forth in claim 8, means in each of the vehicles for providing on the vehicle an illumination identifying the vehicle when the vehicle is addressed by the central station.

10. In combination as set forth in claim 6, at least one accessory providing an operation when energized, the pads in the plurality having additional controls for providing signals to the central station for addressing the accessory to provide the operation of the accessory, the central station including means responsive to the signals from the additional controls in the pads for addressing the accessory sequentially with the addressing of the vehicles.

11. In a combination as set forth in claim 6, means in each of the pads for visually providing an illumination identifying the vehicle being addressed by the controls in the pad.

12. In a combination as set forth in claim 6, means in each of the vehicles for providing an illumination identifying the vehicle during the time that the vehicle is being addressed by one of the pads.

13. In combination, a plurality of vehicles each having first members to provide a movement of the vehicle in different directions and having first controls operable to provide a movement of the vehicle in the different directions and each having a second member to perform functions and each having second controls operable to obtain the performance of the functions by the second member, a plurality of pads each having a plurality of switches controlling the addressing of any one of the vehicles and controlling the operation of the first and second controls in the addressed vehicle, a central station sequentially responsive to the operation of the switches in the pads for providing for an operation of the first and second controls in the vehicles addressed by the pads, and means in the central station for providing for the addressing of each of the vehicles by the operation of the switches in any one of the pads when the pad previously addressing the vehicle addresses another one of the vehicles.

14. In a combination as set forth in claim 13, the central station being connected by wires to the pads in the plurality to provide power to the pads and to communicate with the pads and being constructed to communicate by wireless to the vehicles in the plurality.

15. In a combination as set forth in claim 14, the central station providing common carrier signals for communication with all of the vehicles in the plurality and providing on such carrier signals modulations providing addresses individual to one of the vehicles and identifying the operation of the first and second switches in the pad addressing the vehicle.

16. In a combination as set forth in claim 13, means in each of the pads for visually indicating in the pad the vehicle being addressed by the operation of the switches in the pad.

17. In combination in a central station for use with a plurality of pads each having a plurality of operable controls for use with a plurality of vehicles each addressable in accordance with the operation of first ones of the controls in any one of the pads and each operable to perform operations in accordance with the operation of second ones of the controls in the addressing pad, first means in the central station for receiving from the pads signals indicating the selection of the vehicles and the operation of the first and second controls in the pads, second means responsive in the central station to the signals indicating the selection of vehicles by the pads for producing addresses identifying the vehicles selected by the pads, and third means responsive to the production by the second means of the addresses identifying the vehicles selected by the pads for sequentially transmitting signals indicating the addresses of the vehicles and the operation of the second controls in the pads.

18. In a combination as set forth in claim 13, the central station being connected by wires to the pads to provide power to the pads and to communicate with the pads and the central station including an antenna for transmitting on a wireless basis to the vehicles the signals addressing the vehicles and representing the operation of the controls in the pads addressing the vehicles.

19. In combination for providing first signals addressing any one of a plurality of vehicles and indicating functions to be performed in the addressed vehicle, a pad, a plurality of switches in the pad, a first one of the switches being operable sequentially in the pad to provide for the addressing of any one of the vehicles dependent upon the number of the sequential operations of the first one of the switches in the pad, second ones of the switches being operable in the pad to provide for the performance of the functions in the addressed vehicle, the pad being constructed to be periodically interrogated to indicate the operation of the switches in the pad, and first means responsive in the pad to the periodic interrogation of the pad for providing signals indicating the number of sequential operations of the first switch in the pad and the operation of the second ones of the switches in the pad.

20. In a combination as set forth in claim 19, means for visually indicating in the pad the vehicle addressed by the pad.

21. In combination for providing first signals addressing any one of a plurality of vehicles and indicating functions to be performed in the addressed vehicle, a pad, a plurality of switches in the pad, at least a first one of the switches being operable in the pad to provide for the addressing of any one of the vehicles.

second ones of the switches being operable in the pad to provide for the performance of the functions in the addressed vehicle.

the pad being constructed to be periodically interrogated to indicate the operation of the switches in the pad, and first means responsive in the pad to the periodic interrogation of the pad for providing signals indicating the operation of the first and second switches in the pad.

the first means in the pad including means for sending the signals indicating, in a particular sequence and in a binary-coded form, the number of the sequential operations of the first switch and the operation of the second ones of the switches in the pad.

22. In combination for providing first signals addressing any one of a plurality of vehicles and indicating functions to be performed in the addressed vehicle, a pad, a plurality of switches in the pad, a first one of the switches being operable in the pad to provide for the addressing of any one of the vehicles, second ones of the switches being operable in the pad to provide for the performance of the functions in the addressed vehicle.

the pad being constructed to be periodically interrogated to indicate the operation of the switches in the pad, and first means responsive in the pad to the periodic interrogation of the pad for providing signals indicating the operation of the first and second switches in the pad, the first one of the switches in the pad being operable in a particular number of successive actuations to provide for an addressing of the vehicle, and second means in the pad for visually indicating the addressing of the vehicle.

23. In a combination as set forth in claim 22, the first means in the pad including means for sending to a removed position the signals indicating, in a particular sequence and in a binary-coded form, the operation of the first and second ones of the switches in the pad.

24. In a method of selectively controlling the operation of a plurality of toy vehicles, the steps of:

providing a plurality of pads each having controls operable to address any one of the vehicles and to select functions to be performed in the addressed vehicle, operating controls in each of the pads to obtain the addressing by the pad of any one of the vehicles and to select functions to be performed in the addressed vehicle, providing for an activation of the pads to determine the addressing by each of the pads of a one of the vehicles, providing for the sequential transmission to all of the vehicles, upon the activation of the pads, of signals addressing the vehicles and signals indicating the functions to be performed by the addressed vehicles, providing for the reception by each of the vehicles of the signals indicating the address of the vehicle and the signals indicating the functions to be performed in the addressed vehicle, performing the functions in each of the addressed vehicles in accordance with the operation of the controls in the pad addressing the vehicle, and preventing each of the vehicles from being addressed simultaneously by more than one of the pads.

25. In a method as set forth in claim 24, the steps of:

providing packets each including the signals indicating the address of one of the vehicles and the functions to be performed in the addressed vehicle, and responding at each of the vehicles to the packets of signals addressing the vehicle to perform in the addressed vehicle the functions indicated by the signals in the packets.

26. In a method as set forth in claim 24, the steps of:

providing packets each including the signals indicating the address of any one of the vehicles and the functions to be performed in the addressed vehicle, performing in each of the vehicles the functions indicated in the packets of signals addressing the vehicle, providing a plurality of accessories each operative to perform a function, operating one of the controls in each of the pads to address one of the accessories, providing for the transmission to each of the accessories of packets of signals addressing the accessory when the control in one of the pads is operated to address the accessory, and providing for the transmission to the vehicles on a wireless basis of the packets of signals addressing the vehicles and signals providing for the performance of the functions in the addressed vehicles.

27. In a method as set forth in claim 24, the step of:

visually indicating in each of the pads the vehicle addressed by the pad.

28. In a method as set forth in claim 27, the step of:

visually indicating in each of the pads one of the vehicles other than the vehicle previously addressed by the pad when the pad addresses the other one of the vehicles.

29. In a method as set forth in claim 24, the steps of:

visually indicating in each of the pads the vehicle addressed by the pad, and providing for the addressing of the vehicle by any one of the pads, including the pad addressing the vehicle, when the pad addressing the vehicle addresses another one of the vehicles.

30. (In a method as set forth in claim 25, the steps of:)

In a method of selectively controlling the operation of a plurality of toy vehicles, the steps of:

providing a plurality of pads each having controls operable to address any one of the vehicles and to select functions to be performed in the addressed vehicle, operating controls in each of the pads to obtain the addressing by the pad of any one of the vehicles and to select functions to be performed in the addressed vehicle, providing for a periodic activation of each of the pads to determine the addressing by the pad of any one of the vehicles, providing for a sequential transmission by the pads, upon the periodic activation of the pads, of signals addressing in each of the pads any one of the vehicles and signals indicating the functions to be performed in the addressed vehicle, providing for the reception by the vehicles of the signals indicating the addresses of the vehicles and the signals indicating the functions to be performed in the addressed vehicles, performing the functions in each of the addressed vehicles in accordance with the operation of the controls in the pad addressing the vehicle.

providing a plurality of accessories each operative to perform a function, operating one of the controls in each of the pads to address any one of the accessories, and providing for the transmission to each of the accessories of signals addressing the accessory when the control in one of the pads is operated to address the accessory.

31. In a method as set forth in claim 30, including the step of:

providing for the transmission to the vehicles on a wireless basis of the signals addressing the vehicles and the signals providing for the performance of the functions in the addressed vehicles.

32. In a method at a central station for controlling the operation of a plurality of vehicles in accordance with the addressing of the vehicles by a plurality of pads and in accordance with the operation in the pads of controls to obtain the performance of functions in the addressed vehicles, the steps of:

receiving from each of the pads, on a periodic basis with the others of the pads, first indications providing for the addressing of any one of the vehicles and second indications of functions to be performed in the addressed vehicle, producing first signals addressing any one of the vehicles in accordance with the receipt of the first indications on the periodic basis from the pad addressing the vehicle, producing for each of the addressed vehicles second signals indicating the functions to be performed in the addressed vehicle in accordance with the receipt on the periodic basis of the second indications from the pad addressing the vehicle, combining the first and second signals on the periodic basis for each of the pads to produce packets of the first and second signals, and sequentially transmitting to all of the vehicles the packets of the signals for the pads on the periodic basis to obtain the reception by the vehicles of the packets of signals and to obtain the performance of the functions in each of the addressed vehicles in accordance with the second signals in the packets of signals in which the first signals are addressed to the vehicle.

33. In combination in a vehicle for use with control means having properties of providing packets of signals, each packet including first signals providing a binary address of the vehicle different from binary addresses for other vehicles and second signals providing binary indications of functions to be performed in the vehicle, the control means being operable to address the vehicle when one of pads in a plurality is operated to provide indications of the address of the vehicle and indications of the functions to be performed in the vehicle, the control means being operable to provide third signals when the pad indicating the address of the vehicle indicates the address of a second one of the vehicles, first means responsive to the first signals in the packets from the control means with the binary address of the vehicle for activating the vehicle, second means responsive to the second signals in the packets from the control means with the address of the vehicle for moving the vehicle in forward and reverse directions and for turning the vehicle, third means in the vehicle for receiving and holding the transportable elements and for providing a release of the transportable elements, and fourth means responsive to third ones of the second signals in the packets with the address of the vehicle for operating the fourth means in the vehicle in receiving, holding and releasing the transportable elements, the control means being a central station, the vehicle being displaced from the central station and receiving the signals in the packets on a wireless basis from the central station, and fifth means responsive in the vehicle to the third signals from the control means for deactivating the vehicle.

34. In combination in one of a plurality of pads for providing first signals indicating one of a plurality of vehicles to be addressed and indicating functions to be operated in the vehicle, a plurality of switches in the pad, a first one of the switches being operable to provide for the addressing of the vehicle, second ones of the switches being operable to provide for the performance of the functions in the addressed vehicle, the pad being constructed to be interrogated concerning the operation of the first and second switches in the pad, and first means responsive to the interrogation of the pad for sending signals indicating the operation of the first and second ones of the switches in the pad, the first one of the switches being operable a particular number of times within a particular period of time to provide for the addressing of the vehicle, second means for visually indicating the addressing of the vehicle, and.

35. In a combination as set forth in claim 34, the pad being constructed to be interrogated by a central station, the first means in the pad including means for sending to the central station the signals indicating, in a particular sequence and in a binary-coded form, the operation of the first switch and the second ones of the switches in the pad.

36. In a combination as set forth in claim 34, third means responsive to the successive actuations of the first one of the switches for skipping the addressing of the vehicles being addressed by other pads in the plurality.

37. In a method at a central station for controlling the operation of a plurality of vehicles in accordance with the addressing of the vehicles by pads in a plurality and in accordance with the operation in the pads of controls to obtain the performance of functions in the vehicles, the steps of:

receiving from each of the pads first indications of the addressing of any one of the vehicles and second indications of functions to be performed in the addressed vehicle, producing first patterns of signals indicating the address of the vehicle addressed by each of the pads in accordance with the receipt of the first signals from the pad, producing for each of the vehicles, in accordance with the second indications from the pad addressing the vehicle, a second pattern of signals indicating the functions to be performed in the vehicle, combining the first and second patterns of signals for each of the pads to produce packets of the first and second signals, and sequentially transmitting to all of the vehicles the packets of the signals in the first and second patterns for the pads, and preventing each of the vehicles from being addressed by any one of the pads, other than the pad addressing the vehicle, when the vehicle is being addressed by the addressing pad.

38. In combination, a plurality of vehicles each having controls to provide a movement of the vehicle in different directions in accordance with the operation of the controls, a plurality of pads each having a plurality of switches operable to control the addressing of an one of the vehicles and the energizing of the addressed vehicle to provide a movement of the addressed vehicle in the different directions, a central station for sequentially sending signals to the vehicles to address the vehicles in accordance with the operation in the pads of the switches providing for the addressing of the vehicles and to provide movements in the different directions of each of the addressed vehicles in accordance with the operation of the switches in the pad addressing the vehicle.

39. In a combination as set forth in claim 38, the central station including means for providing a signal having a common carrier frequency for the vehicles and for modulating the common carrier frequency signal with signals identifying each of the vehicles and identifying the operation of the switches in each of the pads and for transmitting the modulated carrier signals for each of the vehicles to all of the vehicles in the plurality, the central station being connected to the pads to communicate with the pads and to provide power to the pads and the central station being constructed to communicate on a wireless basis with the vehicles.

40. In a combination as set forth in claim 39, each of the vehicles including means for receiving the signals at the common carrier frequency from the central station and for demodulating the modulations addressed to the vehicle and for providing a movement of the vehicle in accordance with the demodulations.

41. In a combination as set forth in claim 38, the vehicles being constructed to provide an illumination identifying the vehicles during the time that the vehicles are being addressed by the central station.

42. In a combination as set forth in claim 38, the central station having a memory for indicating the vehicle being addressed by each of the pads, and the central station being constructed to remove from the memory the addressing of each of the vehicles by the addressing pad when the pad addresses another one of the vehicles.

43. In combination, a plurality of vehicles each having controls to provide a movement of the vehicle in different directions in accordance with the operation of the controls, a plurality of pads each having a plurality of switches operable to control the addressing of any one of the motorized vehicles and the operation of the controls in the addressed vehicle to provide a movement of the addressed vehicle in the different directions, means for sequentially transmitting to all of the vehicles signals addressing the vehicles, and the operations of the controls in the vehicles in accordance with the operations of the switches in the pads, each of the vehicles being illuminable to identify the vehicle, and means on each of the vehicles for illuminating the vehicle to identify the vehicle during the time that the controls on the vehicle are being operated in accordance with the operation of the switches in the pad addressing the vehicle and means in each of the pads for preventing each of the vehicles from being simultaneously addressed by more than one of the pads.

44. In a combination as set forth in claim 43, means in each of the pads for providing an illumination identifying the vehicle being addressed by the pad during the time that the pad is addressing the vehicle, and means in each of the vehicles for providing for the addressing of the vehicle by any one of the pads, and for changing the illumination of the vehicle, upon a failure of the pad addressing the vehicle to operate any of the controls in the vehicle for a particular period of time after the addressing of the vehicle by the pad.

45. In a combination as set forth in claim 43, each of the vehicles having a member movable on the vehicle independently of any movement of the vehicle and having controls to provide a movement of the member, and each of the pads having additional switches operable to control the operation of additional controls in the addressed vehicle to provide a movement of the member in the addressed vehicle independently of any movement of the addressed vehicle.

46. In a combination as set forth in claim 43 wherein a microcomputer in each vehicle for indicating the period of time that the controls in the vehicle have not been operated and for providing for a release of the vehicle for operation by any of the pads when the switches in the pad providing for the operation of the controls in the vehicle have not been operated for the particular period of time.

47. In combination in a central station for use with a plurality of pads each having a plurality of operable controls and for use with a plurality of vehicles each addressable in accordance with the operation of first ones of the controls in one of the pads and each movable in accordance with the operation of second ones of the controls in the pad, a microcomputer in the central station, means including the microcomputer in the central station for indicating the pads being operated at each instant and the vehicles being addressed by the pads, and means including the microcomputer for discontinuing the indications of the operation of the pads and the operation of the vehicles by the pads when the pads address other vehicles.

48. In a combination as set forth in claim 47, each the vehicles being illuminable to indicate the addressing of the vehicle by one of the pads, and means in the central station for providing for the illumination of each of the vehicles when the vehicle is being addressed by one of the pads, and means in the central station for providing for changing the illumination of each of the vehicles when the pad addressing the vehicle addresses another one of the vehicles.

49. In combination in a central station for use with a plurality of pads and a plurality of vehicles each constructed to perform functions, first means for interrogating each of the pads on a periodic basis to determine the operation of the pad in addressing any one of the vehicles and in indicating the functions to be performed by the addressed vehicle, second means for receiving from each of the pads on the periodic basis indications of the vehicle addressed by the pad and the functions to be performed by the addressed vehicle, third means responsive to the indications received by the second means for sequentially producing signals representing the vehicles addressed on the periodic basis by the pads and the functions to be performed by the addressed vehicles, and fourth means for transmitting to the vehicles the signals sequentially produced by the third means.

50. In a combination as set forth in claim 49, connections for wires extending from the central station to the pads to provide power to the pads and to communicate with the pads, an antenna at the central station for sending the signals to the vehicles.

51. In a combination as set forth in claim 49, a memory for indicating the relationship between each of the pads and the vehicle addressed by the pad, fourth means for eliminating in the memory the relationship between each of the pads and the vehicle addressed by the pad when the pad addresses another one of the vehicles, and fifth means for releasing the vehicle from being addressed by the pad previously addressing the vehicle when the pad addresses another one of the vehicles.

52. In combination as set forth in claim 49 wherein the functions to be performed in the vehicle include moving the vehicle and operating a member in the vehicle and wherein the first means interrogates each of the pads on the periodic basis to determine the operation of the pad in providing for a movement of the vehicle addressed by the pad and in providing for the operation of the operable member in the addressed vehicle and wherein the third means provides, on the periodic basis for each of the pads, signals indicating the movements of the vehicle addressed by the pad and the operation of the operable member in the addressed vehicle.

53. In a pad for addressing one of a plurality of vehicles each having an address different from the address of the other vehicles, a switch operable a particular number of times within a particular period of time to address the vehicle, and means for transmitting from the pad signals indicating the number of times that the switch has been operated within the particular period of time to address the vehicle.

54. In a pad as set forth in claim 53, means for visually indicating the vehicle addressed by the pad in accordance with the number of times that the switch has been operated within the particular period of time.

55. In a pad as set forth in claim 53 wherein, the pad is one of a plurality of pads and wherein means are provided for skipping over vehicles addressed by other pads in the plurality when the switch is operated the particular number of times to address the vehicle.

56. In a pad as set forth in claim 53 wherein the pad has a visual indication illuminable for each of the vehicles in the plurality and wherein the visual indications for the vehicles become progressively illuminated as the switch becomes operated a successive numbers of times within the particular period of time and wherein the visual indications of vehicles being addressed by other pads are skipped as the switch in the pad becomes operated the successive number of times within the particular period of time to address the vehicle.

57. In a central station for use with a plurality of pads and a plurality of vehicles, means for receiving from each of the pads on a cyclic basis within a particular period of time a plurality of successive indications identifying the address of one of the vehicles, means for converting the successive indications from each of the pads to a plurality of signals indicating the address of the vehicle identified by the successive indications from the pad, and means for transmitting to the vehicles the plurality of signals provided for each of the pads to address the vehicle identified by the signals.

58. In a central station as set forth in claim 57 wherein wires extend from the central station for connection to the pads and wherein an antenna is provided for the transmission to the vehicles of the signals addressing the vehicles.

59. In a central station as set forth in claim 58 wherein a memory is provided for storing the relationship between each pad and the vehicle addressed by the pad and wherein the relationship between each pad and the vehicle addressed by the pad is removed from the memory when the pad addresses another one of the vehicles.

60. In combination, a plurality of vehicles each having an address different from the address of the other vehicles, a plurality of pads each including a switch operable a number of times within a particular period of time; the number being dependent upon the address of the vehicle whose operation is to be controlled by the pad, and a central station responsive to the number of operations of the switch in each of the pads within the particular period of time for providing signals in a pattern addressing the vehicle whose operation is to be controlled by the pad and for transmitting the signals to the vehicles.

61. In combination as set forth in claim 60 wherein each of the pads provides a visual indication of the vehicle addressed by the pad during the time that the pad is addressing the vehicle.

62. In combination as set forth in claim 60 wherein the central station provides a pairing between each pad and the vehicle addressed by the pad during the time that the vehicle is addressed by the pad and wherein the central station stores the pairing between each pad and the vehicle addressed by the pad and wherein the central station releases the stored pairing between each pad and the vehicle addressed by the pad when the pad addresses another one of the vehicles.

63. In a combination as set forth in claim 60 wherein the central station is connected by wires to the pads to provide a communication with the pads and to provide power to the pads and wherein the central station communicates on a wireless basis with the vehicles.

64. In a central station as set forth in claim 60 wherein each of the pads provides a visual indication of the vehicle addressed by the pad during the time that the pad is addressing the vehicle and wherein the central station provides a pairing between each pad and the vehicle addressed by the pad during the time that the vehicle is addressed by the pad and wherein the central station stores the pairing between each pad and the vehicle addressed by the pad and wherein the central station releases the stored pairing between each pad and the vehicle addressed by the pad when the pad addresses another one of the vehicles.

65. In a central station for addressing a plurality of vehicles in accordance with the operation of a plurality of pads, means for receiving from each of the pads on a cyclic basis an indication of the vehicle addressed by the pad, means for indicating the vehicles addressed by the pads, and means responsive to the indications from each of the pads of the vehicle addressed by the pad for skipping the vehicles addressed by the other pads in determining the vehicle addressed by the pad.

66. In a combination as set forth in claim 65, means for storing a paired relationship between each of the pads and the vehicle addressed by the pad, and means for releasing from storage the paired relationship between each pad and the vehicle addressed by the pad when the pad addresses another one of the vehicles.

67. In a combination as set forth in claim 66, means for transmitting to the vehicles signals indicating the addresses of the vehicles addressed by the pads.

68. In a central station for use with a plurality of pads and a plurality of accessories, means for receiving from each of the pads within a particular period of time a plurality of successive indications identifying the address of one of the accessories, means for converting the successive indications from each of the pads to a plurality of signals indicating the address of the accessory identified by the successive indications from the pad, and means for transmitting to the accessories signals provided for each of the accessories to address the accessory identified by the signals.

69. In a combination as set forth in claim 68 wherein first wires extend from the central station for connection to the pads and wherein second wires extend from the central station for connection to the accessories.

70. In a central station as set forth in claim 69 where a memory is provided for storing the relationship between each pad and the accessory addressed by the pad and wherein the relationship between each pad and the accessory addressed by the pad is removed from the memory when the pad addresses another one of the accessories.

71. In combination, a plurality of vehicles each having an address different from the addresses of the other vehicles, a plurality of accessories each having an address different from the addresses of the other accessories, a plurality of pads each including a first switch operable a number of times within a first period of time, the number of operations of the first switch in each of the pads within the first period of time being dependent upon the address of the vehicle whose operation is to be controlled by the pad, each pad including a second switch operable a number of times within a second period of time, the number of operations of the second switch in each pad within the second period of time being dependent upon the address of the accessory whose operation is to be controlled by the pad, and a central station responsive to the number of operations of the first switch in each of the pads within the first period of time for providing first signals in a pattern addressing the vehicle whose operation is to be controlled by the pad and responsive to the number of operations of the second switch in each of the pads within the second period of time for providing second signals in a pattern addressing the accessory whose operation is to be controlled by the pad.

72. In a combination as set forth in claim 71, means in the central station for pairing and storing each of the pads and the vehicle being addressed by the pad and for pairing and storing each of the pads and the accessory being addressed by the pads, and means in the central station for eliminating the storage of the paired relationship between each of the pads and the paired vehicle when the pad addresses another one of the vehicles and for storing the paired relationship between the pad and the other one of the vehicles and for eliminating the storage of the paired relationship between each of the pads and the paired accessory when the pad addresses another one of the accessories and for storing the paired relationship between the pad and the other one of the accessories.

73. In a combination as set forth in 71 wherein each of the vehicles has a movable member for providing a movement of the vehicle and has an operable member for providing a function other than the movement of the vehicle and wherein each of the pads provides indications of the desired movements of the movable member in the addressed vehicle and of the functions to be performed by the operable member in the addressed vehicle and wherein the central station provides for each of the pads packets of signals including first signals indicating the address of the vehicle being controlled by the pad, second signals indicating the desired movements of the movable member in the addressed vehicle and third signals indicating the functions to be performed by the operable member in the addressed vehicle.

74. In combination, a plurality of vehicles each having an address different from the addresses of the other vehicles, a plurality of pads each constructed to address only one of the vehicles at each instant, a central station associated with the pads and the vehicles for determining and storing the paired relationship between each of the pads and the vehicle addressed by the pad and for addressing the paired vehicle in accordance with indications from the pads, and means in the central station for eliminating the stored paired relationship between each of the pads and the vehicle addressed by the pad when the pad addresses another one of the vehicles and for storing in the central station the paired relationship between the pad and the other one of the vehicles.

75. In a combination as set forth in claim 74, each of the vehicles being constructed to perform functions in accordance with commands from the pad addressing the vehicle, each of the pads being constructed to provide commands to the addressed vehicle when it addresses the vehicle for the performance of functions in the addressed vehicle, and the central station being constructed to provide the commands from each of the pads to the vehicle addressed by the pad when the central station addresses the vehicle.

76. In a combination as set forth in claim 74, the central station being connected by wires to the pads, an antenna on the central station for transmitting to the vehicles the addresses from the pads, and antennas on the vehicles for receiving the addresses from the pads.

77. In a combination as set forth in claim 76, each of the vehicles being constructed to be moved in accordance with commands from the pad addressing the vehicle, each of the pads being constructed to provide the commands to the addressed vehicle when the pad addresses the vehicle for the performance of functions in the addressed vehicles, and the central station being constructed to provide the commands from each of the pads to the vehicle addressed by the pad when the central station addresses the vehicle.

78. In a combination as set forth in claim 76, each of the vehicles having a member movable on the vehicle to perform functions in accordance with commands from the pad addressing the vehicle, each of the pads being constructed to provide the commands for moving the member on the addressed vehicle, and the central station being constructed to provide the commands from each of the pads for moving the movable member in the vehicle addressed by the pad when the central station addresses the vehicle.

79. In combination in a central station for use with a plurality of pads and for use with a plurality of vehicles each having an address different from the addresses of the other vehicles and each having first members for moving the vehicle and each having an operable member, first means for receiving from each of the pads, on a periodic basis, indications of the address of one of the vehicles, indications of the movements to be provided in the addressed vehicle by the first members in the addressed vehicle and indications of the operations to be provided by the operable member in the addressed vehicle, and second means responsive to the indications on the periodic basis from the pads for sequentially transmitting to the vehicles on the periodic basis signals representing the addresses of the vehicles being addressed by the pads, representing movements to be provided in the addressed vehicles by the first members in the addressed vehicles and representing the operations to be provided by the operable member in the addressed vehicles.

80. In a combination as set forth in claim 79, third means for providing a pairing of each of the pads and the vehicle addressed by the pad during the time that the vehicle is addressed by the pad and for storing the pairing of the pad and the vehicle addressed by the pad during the time that the vehicle is addressed by the pad, and fourth means for eliminating the storage of the pairing of each of the pads and the vehicle addressed by the pad when the pad addresses another one of the vehicles and for providing a pairing of the pad and the other one of the vehicles during the time that the other one of the vehicles is addressed by the pad and for providing for a storing by the third means of the pairing of the pad and the other one of the vehicles during the time that the other one of the vehicles is addressed by the pad.

81. In a combination as set forth in claim 79, connections for wires extending from the central station to the pads to provide power to the pads and to communicate with the pads, and an antenna for transmitting the signals on a wireless basis to the vehicles.

82. In a combination as set forth in claim 78 for use with a plurality of accessories each having an address different from the addresses of the other accessories, the first means being operative to receive from each of the pads on the cyclic basis indications of the address of one of the accessories, and the second means being responsive to the indications from each of the pads to transmit on the cyclic basis to the accessories signals representing the address of the vehicle being addressed by the pad, signals representing the movements to be provided in the addressed vehicle by the first members in the addressed vehicle, signals representing the operations to be provided by the operable member in the addressed vehicle and signals representing the addresses of the accessory being addressed by the pad.

83. In a combination as set forth in claim 82, third means for storing a pairing of each of the pads and the vehicle addressed by the pad and a pairing of each of the pads and the accessory addressed by the pad, and fourth means for eliminating the storage of the pairing of each of the pads and the vehicle addressed by the pad when the pad addresses another one of the vehicles and for then providing for a storage by the third means of the pairing of the pad and the other one of the vehicles and for eliminating the storage of the pairing of each of the pads and the accessory addressed by the pad when the pad addresses another one of the accessories and for providing for a storage by the third means of the pairing of the pad and the other one of the accessories.

84. In a combination as set forth in claim 83, connections for wires extending from the central station to the pads and the accessories, and an antenna for transmitting the signals on a wireless basis to the pads.

85. In combination, a plurality of vehicles each having an address different from the addresses of the other vehicles, a plurality of pads each operable to provide first signals for addressing any one of the vehicles and second signals for providing operations of the addressed vehicle, means responsive to the first and second signals from the pads for sequentially sending packets of signals to the vehicles in the plurality for addressing the vehicles and for providing operations of the addressed vehicles, and means for providing a stored record indicating a pairing between any one of the vehicles and the pad addressing the vehicle during the time that the pad is addressing the vehicle means for eliminating the stored record of the pairing between each vehicle and the pad addressing the vehicle when the pad addresses another one of the vehicles, and means for providing a stored record of the pairing between the other one of the vehicles and the pad during the time that the pad addresses the other one of the vehicles.

86. In a combination as set forth in claim 85, each of the vehicles additionally including an operable member, each of the pads being constructed to include in the packets signals providing for the operation of the operable member in the vehicle being addressed by the pad.

87. In a combination as set forth in claim 85, means for providing a movement of each of the vehicles and for an operation of the operable member in the vehicle in accordance with the signals in the packets addressed to the vehicle.

88. In combination in a vehicle for use with control means having properties of providing packets of signals, each packet including first signals providing a binary address of the vehicle different from binary addresses for other vehicles and second signals for providing binary indications of functions to be performed in the vehicle, the control means being operable to address the vehicle when one of the pads in a plurality is operated to provide indications of the address of the vehicle and indications of the functions to be performed in the vehicle, the control means being operable to provide third signals when the pad indicating the address of the vehicle indicates the address of a second one of the vehicles, first means responsive to the first signals in the packets from the control means with the binary address of the vehicle for activating the vehicle, second means responsive to the second signals in the packets from the control means with the address of the vehicle for performing the functions indicated by the second signals, and third means responsive to the third signals from the control means for de-activating the vehicle.

89. A method of controlling the operation of toy vehicles, including the steps of:

providing each of the toy vehicles with an address different from the addresses of the other vehicles, providing a plurality of pads each providing addresses for any one of the vehicles, providing for an addressing by each of the pads of any one of the vehicles, providing for an operation by each of the pads of one of the vehicles after the addressing of the vehicle by the pad, providing for the sequential transmission to all of the vehicles of signals indicating the addressing of the vehicles by the pads and indicating the operations of the addressed vehicles providing for a release of each of the vehicles by the pad controlling the operation of the vehicle when the pad addresses another one of the vehicles and preventing each the vehicles from being simultaneously addressed by more than one of the pads.

90. A method as set forth in claim 89, including the steps of:

providing on each of the pads a plurality of visual indications identifying the individual ones of the vehicles, and providing for an energizing on each of the pads of the visual indication identifying the vehicle addressed by the pad.

91. A method as set forth in claim 89, including the steps of:

providing on each of the a visual indication identifying the vehicles, and energizing the visual indication on each of the vehicles when the vehicle is addressed by one of the pads.

92. A method as set forth in claim 89, including the steps of:

providing a control on each of the pads with a plurality of sequentially operable positions each identifying an individual one of the vehicles, and sequentially operating the control in each of the pads to one of the control positions providing for an addressing of the vehicle identified by the one of the control positions.

93. A method as set forth in claim 92, including the steps of:

providing for a skipping, during the sequential operation of the control in each of the pads, of the control positions identifying vehicles addressed by the other pads.

94. A method as set forth in claim 93, including the steps of:

providing on each of the pads a plurality of visual indications identifying the individual ones of the vehicles, providing for an energizing on each of the pads of the visual indication identifying the vehicle addressed by the pad, providing on each of the vehicles a visual indication identifying the vehicle, and energizing the visual indication on each of the vehicles when the vehicle is addressed by one of the pads.

95. A method of controlling the operation of toy vehicles, including the steps:

providing each of the toy vehicles with an address different from the addresses of the other toy vehicles, providing a plurality of pads each having a first control for addressing any one of the vehicles and each having second controls for operating the addressed vehicle(s) after the vehicle(s) has been addressed, providing for an addressing by each of the pads of one of the vehicles in accordance with the operation of the first control in the pad and for the operation of the vehicle in accordance with the operation of the second controls in the pad after the vehicle has been addressed by the pad, providing for a release of the vehicle by the pad controlling the operation of the vehicle when the pad addresses another one of the vehicles, providing for the sequential transmission to all of the vehicles of signals indicating the addresses of the vehicles by the pads and indicating the operations of the addressed vehicles, providing for an addressing of each of the vehicles by the operation of the first control in any one of the pads when the vehicle is released by the pad previously addressing the vehicle.

96. A method as set forth in claim 95, including the steps of:

providing on each of the pads a plurality of visual indications identifying the individual ones of the vehicles, and providing for an energizing on each of the pads of the visual indication identifying the vehicle addressed by the pad.

97. A method as set forth in claim 95, including the steps of:

providing on each of the vehicles a visual indication identifying the vehicle, and energizing the visual indication on each of the vehicles when the vehicle is addressed by one of the pads.

98. A method as set forth in claim 95, including the steps of:

providing a control on each of the pads with a plurality of sequentially operable positions each identifying an individual one of the vehicles, and sequentially operating the control in each of the pads to one of the control positions providing for an address of the vehicle identified by the one of the switch positions.

99. A method as set forth in claim 98, including the steps of:

providing for a skipping, during the sequential operation of the control in each of the pads, of the control positions identifying vehicles addressed by the other pads.

100. A method as set forth in claim 99, including the steps of:

providing on each of the pads a plurality of visual indications identifying the individual ones of the vehicles, providing for an energizing on each of the pads of the visual indication identifying the vehicle addressed by the pad, providing on each of the vehicles a visual indication identifying the vehicles, and energizing the visual indication on each of the vehicles when the vehicle is addressed by one of the pads.

101. A method of controlling the operation of toy vehicles, including the steps of:

providing each of the toy vehicles with an address different from the addresses of the other vehicles, providing a plurality of pads each having a first control operable to provide for the addressing of any one of the vehicles and each having second controls operable to provide for an operation of the addressed vehicle, providing a central station for sequentially communicating to all of the vehicles the addresses provided by the operation of the first control in the pads and the operation of the addressed vehicles as provided by the operation of the second controls in the pads providing for an addressing by the central station of each of the vehicles in accordance with the addressing of the vehicle by the operation of the first control in the pads, providing in the central station for an operation of each of the vehicles in accordance with the operation of the second controls in the pad addressing the vehicle, and providing in the central station for a release of each of the vehicles by the pad controlling the operation of the vehicle when the pad addresses another one of the vehicles in accordance with the operation of the first control in the pad.

102. A method as set forth in claim 101, including the step of:

providing in the central station for an addressing of each of the vehicles by the operation of the first control in any of the pads after the release of the vehicle by the pad controlling the operation of the vehicle.

103. A method as set forth in claim 102, including the steps of:

providing in each of the pads a plurality of visual indications identifying the individual ones of the vehicles, providing for an energizing in each of the pads of the visual indications identifying the vehicle addressed by the pad, providing on each of the vehicles a visual indication identifying the vehicle, and energizing the visual indication on each of the vehicles when the vehicle is addressed by one of the pads.

104. A method as set forth in claim 102, including the steps of:

providing the first control in each of the pads with a plurality of sequentially operable positions each identifying an individual one of the vehicles addressed by the operation of the first control in the pad, sequentially operating the first control in each of the pads to one of the control positions providing for a selection of the vehicle identified by the one of the control positions, providing for a skipping, during the sequential operation of the first control in each of the pads, of the control positions identifying vehicles selected by the other pads.

105. A method as set forth in claim 104, including the steps of:

providing in each of the pads a plurality of visual indications identifying the individual ones of the vehicles, providing for an energizing in each of the pads of the visual indications identifying the vehicle addressed by the pad, providing on each of the vehicles a visual indication identifying the vehicle, and energizing the visual indication on each of the vehicles when the vehicle is addressed by one of the pads.

106. A method as set forth in claim 101, including the steps of:

providing in each of the pads a plurality of visual indications identifying the individual ones of the vehicles, providing for an energizing in each of the pads of the visual indications identifying the vehicle addressed by the pad, providing on each of the vehicles a visual indication identifying the vehicle, and energizing the visual indication on each of the vehicles when the vehicle is addressed by one of the pads.

107. A method as set forth in claim 101, including the steps of:

providing the first control in each of the pads with a plurality of sequentially operable positions each identifying an individual one of the vehicles addressed by the operation of the first control in the pad, and sequentially operating the first control in each of the pads to one of the control positions providing for a selection of the vehicle identified by the one of the control positions.

108. In combination for controlling the operation of toy vehicles, a plurality of toy vehicles each having an address different from the addresses of the other vehicles, a plurality of pads each operable to provide addresses any one of the vehicles and each providing controls for the operation of the addressed vehicles, means for providing for an addressing of any one of the vehicles by each of the pads and for the operation of the addressed vehicle by the operation of the controls in the pad, and means for providing for a release of each of the vehicles by the pad controlling the operation of the vehicle when the pad addresses another one of the vehicles and for providing for the addressing thereafter of the released vehicle by any of the pads.

109. In a combination as set forth in claim 108, each of the pads being constructed to provide energizable indications each identifying one of the vehicles, and means in each of the pads for energizing the visual indication in the pad of the vehicle addressed by the pad.

110. In a combination as set forth in claim 108, each of the vehicles being constructed to provide an energizable indication that the vehicle has been addressed by one of the pads, and means in the vehicle for energizing the visual indication in the vehicle when the vehicle has been addressed by one of the pads.

111. In a combination as set forth in claim 108, each of the pads having an additional control sequentially operable to different positions each identifying an individual one of the vehicles, and means responsive to the sequential operation of the additional control to one of the positions in each of the pads for addressing the vehicle identified by the position of the additional control in the pad.

112. In a combination as set forth in claim 111, means for skipping, during the sequential operation of the additional control in each of the pads, of the positions identifying vehicles selected by the other pads.

113. In a combination as set forth in claim 112, each of the pads being constructed to provide energizable indications each identifying one of the vehicles, and means in each of the pads for energizing the visual indication in the pad of the vehicle addressed by the pad, each of the vehicles being constructed to provide an energizable indication that the vehicle has been addressed by one of the pads, and means in the vehicle for energizing the visual indication in the vehicle when the vehicle has been addressed by one of the pads.

114. In a method at a central station for controlling the operation of a plurality of vehicles in accordance with the addressing of the vehicles by a plurality of pads and in accordance with the operation in the pads of controls to obtain the performance of functions in the vehicles, the steps of:

receiving from the pads first indications of the addresses of the vehicles and second indications of the functions to be performed in the vehicles, producing first signals indicating the addresses of the vehicles addressed by the pads in accordance with the receipt of the first indications from the pads, producing for each of the addressed vehicles second signals indicating the addressed vehicle, combining the first and second signals for each of the vehicles to produce packets of the first and second signals, sequentially transmitting, to all of the vehicles in the plurality, the packets of the first and second signals for the addressed vehicles to provide for the reception of the signals in the addressed vehicles in accordance with the addresses represented by the first signals in the packets and to provide for the performance of the functions in the addressed vehicles in accordance with the second signals in the packets, providing a memory, storing in the memory the addressing of the vehicles by the pads during the time that the vehicles are addressed by the pads, and eliminating from the memory the addressing of the vehicles by the pads when the pads address vehicles other than the vehicles previously addressed by the pads.

115. In a method as set forth in claim 114, the step of:

preventing each of the vehicles from being addressed by any of the pads other than the pad addressing the vehicle.

116. In a method as set forth in claim 114, the step of:

storing in the memory the addressing of the other vehicles by the pads during the time that the pads address the other vehicles.

117. In combination for use with a plurality of vehicles each having an individual address and having members for moving the vehicles, a central station, a plurality of pads each operatively connected to the central station and each operative to provide addresses individual to any one of the vehicles and to provide commands for operating the vehicle, the central station being operative to receive the addresses and commands from the pads and to transmit to the vehicles addresses and commands in packets each composed of a plurality of binary indications representing the address and the commands for an individual one of the vehicles, means in the central station for transmitting the packets of the binary indications to the vehicles, each of the pads including a switch actuatable a number of times to select any one of the vehicles, the particular number of times being dependent upon the particular one of the vehicles to be addressed by the pad, memory means in the central station for remembering each of the vehicles addressed at any instant and the pad addressing the vehicle, and means in the central station for preventing each of the pads from addressing one of the vehicles already being addressed by another one of the pads.

118. In combination for use with a plurality of vehicles each having an individual address and having members for moving the vehicles, a central station, a plurality of pads coupled to the central station, each of the pads having a first member actuatable a sequential number of times to address any one of the vehicles dependent upon the number of actuations and having second members actuatable to provide for a movement of the addressed vehicle, means in the central station for interrogating the pads to determine the number of actuations of the first member in each of the pads and to determine the actuations of the second members in each of the pads, means in the central station for providing for each of the pads first binary indications addressing the vehicle being selected by the pad and second binary indications relating to the movements to be provided in the vehicle, means in the central station for remembering each pad and the vehicle selected by the pad and for providing for the transmittal of such information to the pads, and means responsive in the pads to the remembered information transmitted to the pads from the central station for skipping in each pad the binary indications of vehicles already being addressed by others of the pads when the first member in the pad is actuated the sequential number of times.

* * * * *

UNITED STATES PATENT AND TRADEMARK OFFICE

CERTIFICATE OF CORRECTION

PATENT NO. : 5,944,607

DATED : Aug. 31, 1999

INVENTOR(S) : John J. Crane

It is certified that error appears in the above-identified patent and that said Letters Patent is hereby corrected as shown below:

Column 5, line 58, change "42A", to read --42a--.

Column 11, claim 1, line 43, before "one", change "a"", to read --any--.

Column 12, claim 7, line 61, change "Man (each)", to read --any--.

Column 15, claim 24, line 41, before "one", change "a", to read --any--.

Column 16, claim 30, line 30, delete entire line beginning, "(In a method as set forth in claim 25, the steps of:)".

Column 18, claim 34,line 20, after "vehicle", delete ", and".

Signed and Sealed this

Thirtieth Day of May, 2000

*Attest:*

Q. TODD DICKINSON

*Attesting Officer*

*Director of Patents and Trademarks*